US005643107A

United States Patent [19]

Gorman

[11] Patent Number: 5,643,107

[45] Date of Patent: Jul. 1, 1997

[54] GOLF CLUB HEAD SET

[75] Inventor: Geoffrey W. Gorman, Richmond, Va.

[73] Assignee: Dunlop Maxfli Sports Corporation, Greenville, S.C.

[21] Appl. No.: 514,605

[22] Filed: Aug. 14, 1995

Related U.S. Application Data

[63] Continuation-in-part of Ser. No. 349,670, Dec. 5, 1994, Pat. No. 5,441,263.

[51] Int. Cl.[6] ..... A63B 53/04

[52] U.S. Cl. ..... 473/328; 473/291

[58] Field of Search ..... 473/287, 289, 473/290, 291, 292, 324, 328, 327, 334, 341, 345, 350, 349, 344

[56] References Cited

U.S. PATENT DOCUMENTS

| | | | |
|---|---|---|---|
| D. 266,344 | 9/1982 | Duclos | D21/214 |
| D. 344,998 | 3/1994 | Greene | D21/214 |
| D. 352,538 | 11/1994 | Williams, Jr. | D21/214 |
| D. 352,983 | 11/1994 | Williams, Jr. | D21/214 |
| 1,913,821 | 6/1933 | Stumpf | 273/174 |
| 2,041,676 | 5/1936 | Gallagher | 273/77 |
| 2,756,055 | 7/1956 | Bittner | 273/174 X |
| 2,954,231 | 9/1960 | MacIntyre | 273/164 |
| 3,068,011 | 12/1962 | Sano | 273/174 |
| 3,955,819 | 5/1976 | Yokich | 273/164 |
| 3,997,170 | 12/1976 | Goldberg | 273/164 |
| 4,065,133 | 12/1977 | Gordos | 273/167 E |
| 4,838,555 | 6/1989 | Kobayashi | 273/167 |
| 5,257,786 | 11/1993 | Gorman | 273/167 A |
| 5,271,622 | 12/1993 | Rogerson | 273/174 |
| 5,301,945 | 4/1994 | Schmidt et al. | 273/167 A |
| 5,314,185 | 5/1994 | Gorman | 273/172 |
| 5,516,106 | 5/1996 | Henwood | 473/350 |

FOREIGN PATENT DOCUMENTS

| | | | |
|---|---|---|---|
| 6733 | 1/1980 | European Pat. Off. | 273/167 A |
| 244925 | 12/1925 | United Kingdom | 273/167 A |

OTHER PUBLICATIONS

Austad's Holiday, Spaldings Thunder Heat, p. 61.
Jack Nicklaus advertisement.
Tommy Armour Golf advertisement, 1991.
Golf Magazine advertisement, Jan. 1991 p. 129.
Golf Product News advertisement, Mar./Apr. 1994 p. 34.

*Primary Examiner*—Steven B. Wong
*Attorney, Agent, or Firm*—Lorusso & Loud

[57] ABSTRACT

A wood-type golf club head comprising toe, heel, top and sole portions, a front face bounded by the toe, heel, top and sole portions, and a rear wall bounded by the toe, heel, top and sole portions, a peripheral wall depending from the periphery of the sole portion to define a sole cavity in the sole portion, and two struts extending from a portion of the peripheral wall adjacent the front face to a portion of the peripheral wall adjacent the rear wall, the struts being in part substantially parallel to each other and in part diverging from each other and defining therebetween and in cooperation with the portion of the peripheral wall adjacent the front face, a central portion of the sole cavity, the peripheral wall being interrupted adjacent the rear wall, such that the central portion of the sole cavity is open to the rear of the club head.

A set of wood-type golf clubs, in which each club in the set has strut members on the bottom of the club defining a sole cavity, and the center of gravity is placed at the optimum location for each club in the set. On the lower lofted clubs the center of gravity is positioned lower in the club, toward the sole. As the loft of the club increases, the center of gravity moves higher, toward the top portion of the club, with the center of gravity highest on the highest lofted club.

13 Claims, 15 Drawing Sheets

GOLF CLUB HEAD SET

This is a continuation in part application of U.S. Ser. No. 08/349,670, filed Dec. 5, 1994, now U.S. Pat. No. 5,441,263.

BACKGROUND OF THE INVENTION

1. Field of the Invention

This invention relates to golf clubs and is directed more particularly to a wood-type golf club head.

2. Description of the Prior Art

It is known to be beneficial to provide on the sole portion of drivers and fairway metalwoods strut members which extend from the bottom of the club and are elongated and disposed generally normal to the impact face of the club. The strut members reduce the drag experienced by the club head as it moves on or adjacent to the playing surface in approaching the ball. Typically, such struts are attached to the club by way of forming part of a plate which is attached, as by screws, to the sole of the club.

U.S. Pat. No. 3,068,011, issued Dec. 11, 1962 to Naojiro Sano, illustrates such prior art practices. In Sano, a plate having two or three fingers extending from a common bar portion is screwed onto the bottom of a club head such that the bar portion is disposed adjacent the impact face of the club head and the fingers extend rearwardly therefrom, forming front-to-rear struts.

The addition of metal plates, and the like, to the sole portion of drivers tends to exacerbate the already prevalent problem of the center of gravity for such clubs being disposed low in the club, removed from the geometric center of the club.

Golf clubs are designed with varying degrees of loft, ranging from a minimum of about 8 degrees for a number 1 wood to a maximum of about 27 degrees for a wedge type club. The different degrees of loft help to control the trajectory and distance a golf ball is hit. The lower lofted clubs are used for hitting a ball long distances, with the least amount of trajectory. The higher lofted clubs are preferred for hitting the ball shorter distances with a higher trajectory. A problem with existing clubs is that it is often difficult to obtain adequate lift in the lower lofted clubs, while in the higher lofted clubs, offshoot is a problem.

Another problem with existing clubs is that they are often not suitable for imperfect lies, particularly when the sole of the club head has a smooth or flat surface.

It is beneficial to the golfer to have available a driver, or fairway wood-type club, provided with struts on the sole of the club as an integral part of the club, the club being designed in such a manner as to permit location of the center of gravity nearer the geometric center of the club.

It is also beneficial to have available a set of golf clubs in which the center of gravity can be placed at the optimum location for each club in the set.

SUMMARY OF THE INVENTION

Accordingly, an object of the present invention is to provide a wood-type club head having elongated front to rear struts protruding from the sole portion thereof and formed as an integral part of the club.

A further object of the invention is to provide such a club configured so as to place the center of gravity proximate the geometric center of the club head.

A further object of the invention is to provide a set of clubs in which the center of gravity is positioned at the optimum location in the club for each club in the set.

A further object of the invention is to provide a set of golf clubs in which the center of gravity is positioned low, toward the sole of the club in the lower lofted clubs, and higher in the clubs, toward the top of the club, in the higher lofted clubs.

A further object of the invention is to improve the lift of lower lofted clubs.

A further object of the invention is to reduce the potential for offshoot in the higher lofted clubs.

A further object of the invention is to provide a set of clubs which is useful for imperfect lies, as well as fairway positions.

A further object of the invention is to provide a golf club having improved aerodynamic performance.

With the above and other objects in view, as will hereinafter appear, a feature of the present invention is the provision of a wood-type golf club head comprising a toe portion, a heel portion, a top portion, a sole portion, a front face bounded by the toe, heel, top and sole portions, and a rear wall bounded by the toe, heel, top and sole portions, a peripheral wall depending from the periphery of the sole portion to define a sole cavity in the sole portion, and two struts extending from a portion of the peripheral wall adjacent the front face to a portion of the peripheral wall adjacent the rear wall, the struts being in part substantially parallel to each other and in part diverging from each other and defining therebetween and in cooperation with the portion of the peripheral wall adjacent the front face, a central portion of the sole cavity, the peripheral wall being interrupted adjacent the rear wall, such that the central portion of the sole cavity is open to the rear of the club head.

The sole of the club also has a series of rails in the sole cavity to improve the aerodynamic performance of the golf club.

Another feature of the present invention is the provision of a set of wood-type golf clubs, in which each club in the set has strut members on the bottom of the club defining a sole cavity, and the center of gravity is placed at the optimum location for each club in the set. On the lower lofted clubs the center of gravity is positioned lower in the club, toward the sole, as compared to the higher lofted clubs. As the loft of the club increases, the center of gravity moves higher, toward the top portion of the club, with the center of gravity highest on the highest lofted club.

As the loft of the club increases, the depth of the sole cavity increases to help to raise the center of gravity. Extra weight may be placed on the top portion of the club, toward the toe portion to further raise the center of gravity. The length of the hosel may also be adjusted to further optimize the location of the center of gravity.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the claims.

BRIEF DESCRIPTION OF THE DRAWING

Reference is made to the accompanying drawings in which are shown illustrative embodiments of the invention, from which its novel features and advantages will be apparent.

In the drawing.

DETAILED DESCRIPTION OF THE PREFERRED EMBODIMENT

Figure 2:
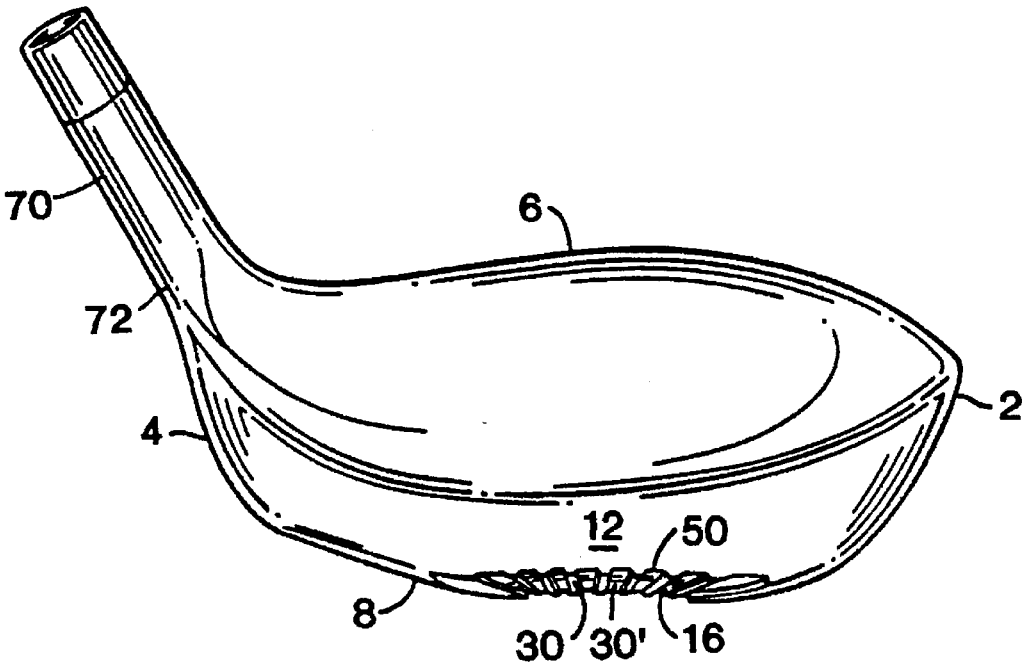
FIG. 2 is a rear elevational view thereof.
Figure 3:
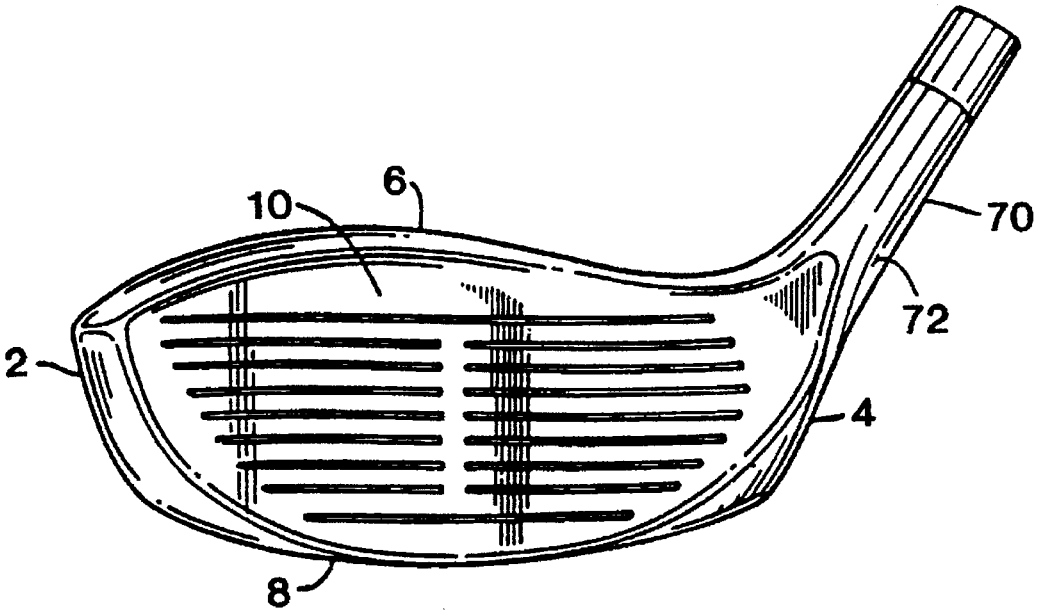
FIG. 3 is a front elevational view thereof.
Figure 4:
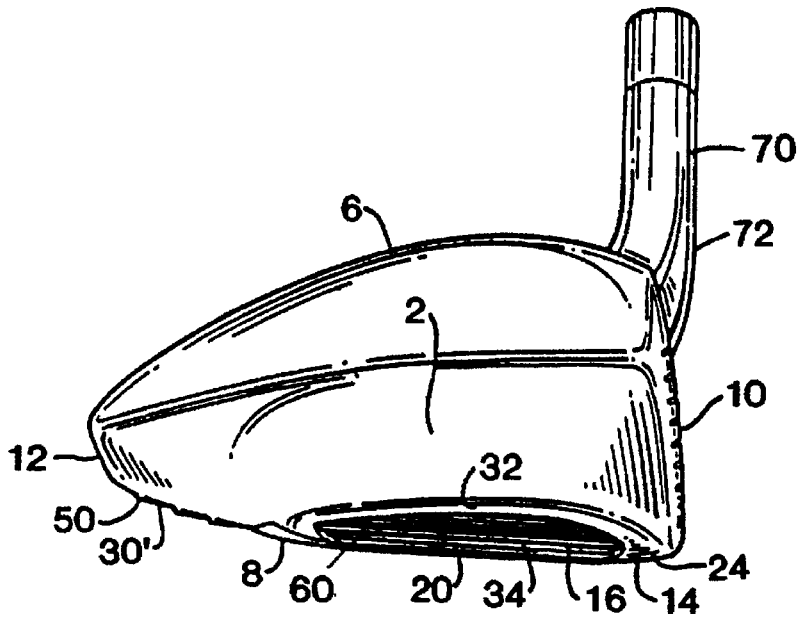
FIG. 4 is a toe end elevational view thereof.
Figure 5:
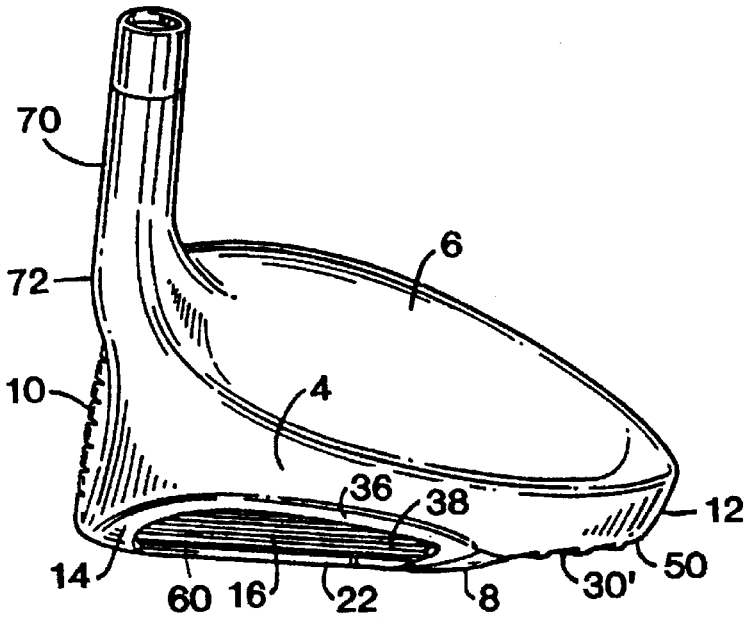
FIG. 5 is a heel end elevational view thereof.
Figure 9:
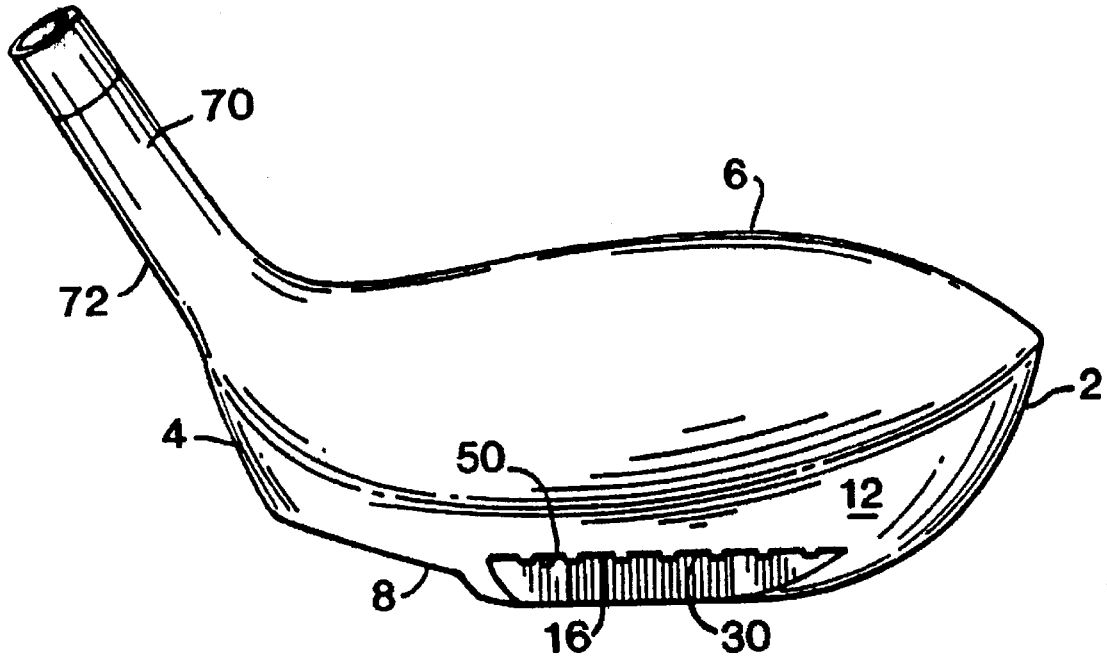
FIG. 9 is a rear elevational view thereof.
Figure 10:
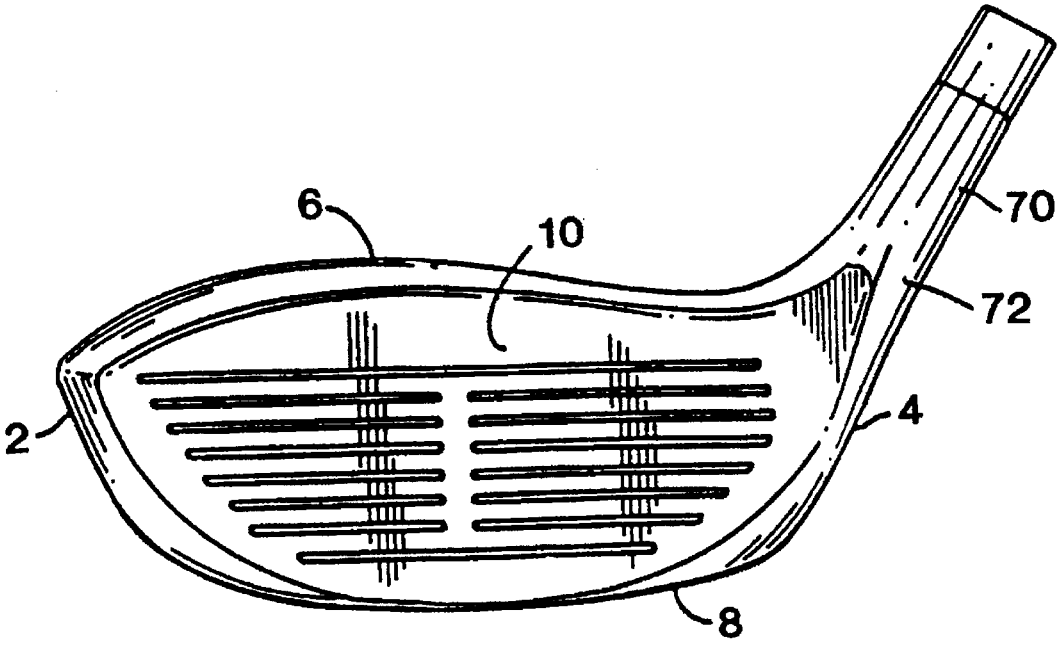
FIG. 10 is a front elevational view thereof.
Figure 11:
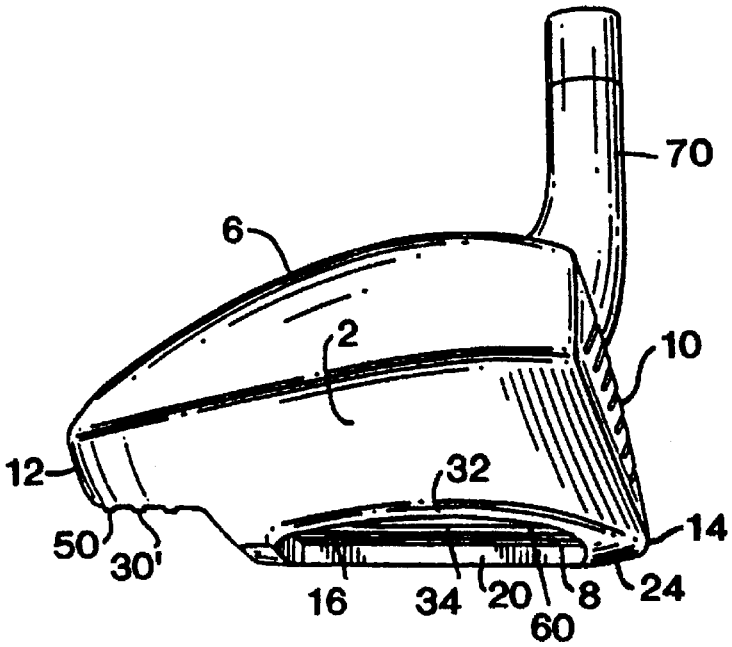
FIG. 11 is a toe end elevational view thereof.
Figure 12:
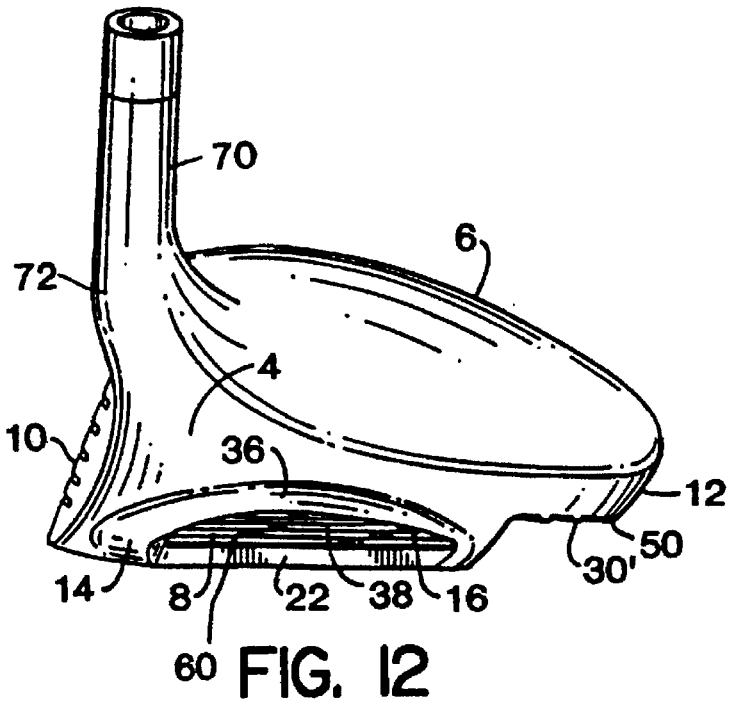
FIG. 12 is a heel end elevational view thereof.

Referring to FIGS. 1–14 of the drawing, it will be seen that the illustrative golf club head includes a toe portion 2, a heel portion 4, a top portion 6, and a sole portion 8. The club further includes a front face 10, bounded by the toe portion 2, heel portion 4, top portion 6, sole portion 8, a hosel portion 70, and a neck portion 72. (FIGS. 3 and 10), and a rear wall 12 bounded by the toe, heel, top and sole portions (FIGS. 2 and 9).

A peripheral wall 14 (FIGS. 1, 6, 8 and 13) depends from the periphery of the sole portion 8 to define a sole cavity 16 in the sole portion. Two struts 20, 22 extend from a portion 24 of the peripheral wall 14 adjacent the front face 10 to a portion 26 of the peripheral wall 14 adjacent the rear wall 12.

The struts 20, 22, are, in part, substantially parallel to each other and define therebetween, in cooperation with the portion 24 of the peripheral wall 14 adjacent the front face 10, a central portion 30 of the sole cavity 16. The struts, 20, 22 diverge from each other near the rear wall 12. The peripheral wall 14 is interrupted adjacent the rear wall 12, such that the central portion 30 of the sole cavity is open to the rear of the club head.

A first 20 of the two struts and a portion 32 of the peripheral wall 14 adjacent the toe portion 2 define a toe portion 34 of the sole cavity 16. A second 22 of the two struts and a portion 36 of the peripheral wall 14 adjacent the heel portion 4 define a heel portion 38 of the sole cavity 16.

Figure 1:
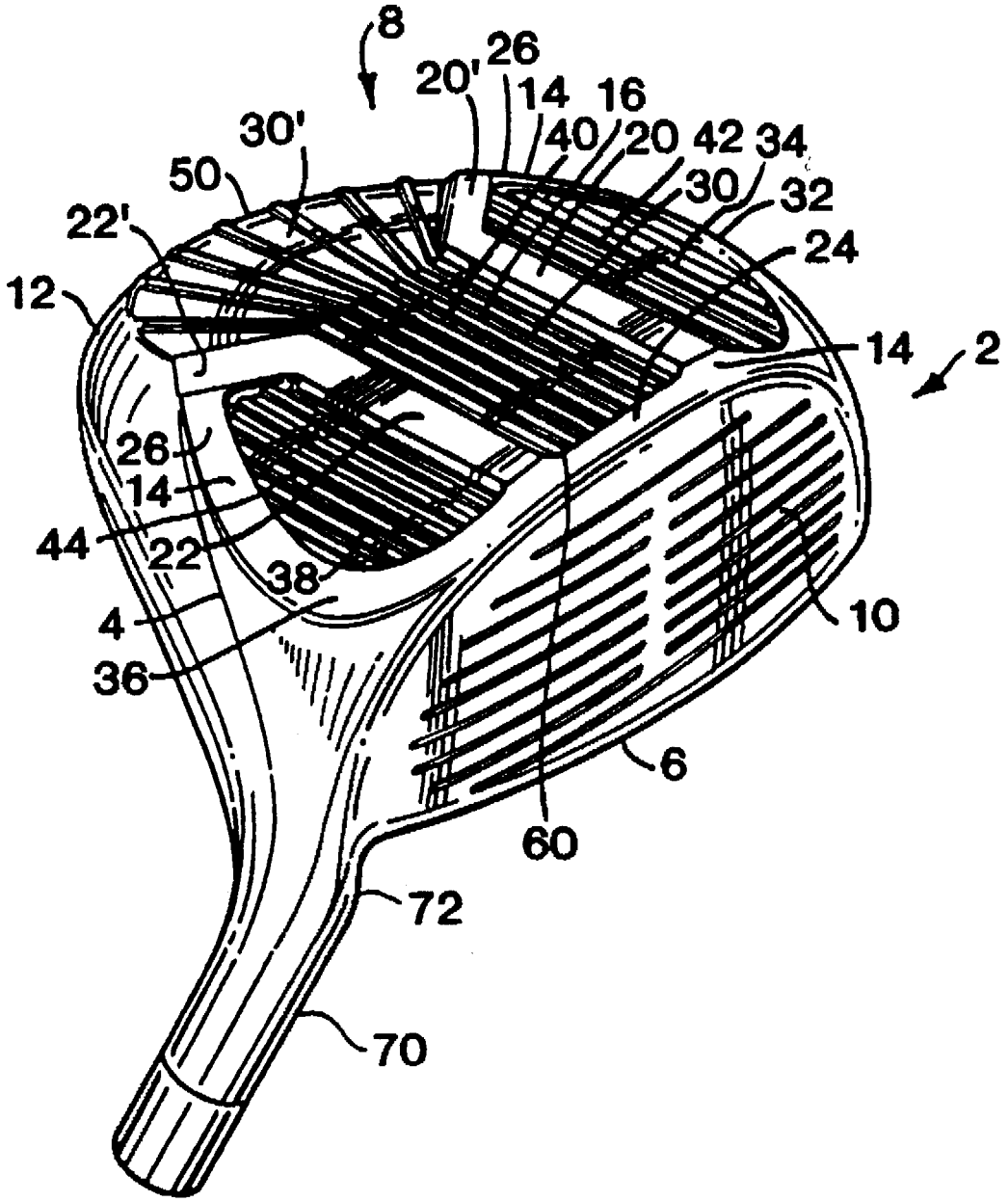
FIG. 1 is a perspective view of one form of golf club head illustrative of an embodiment of the invention.
Figure 8:
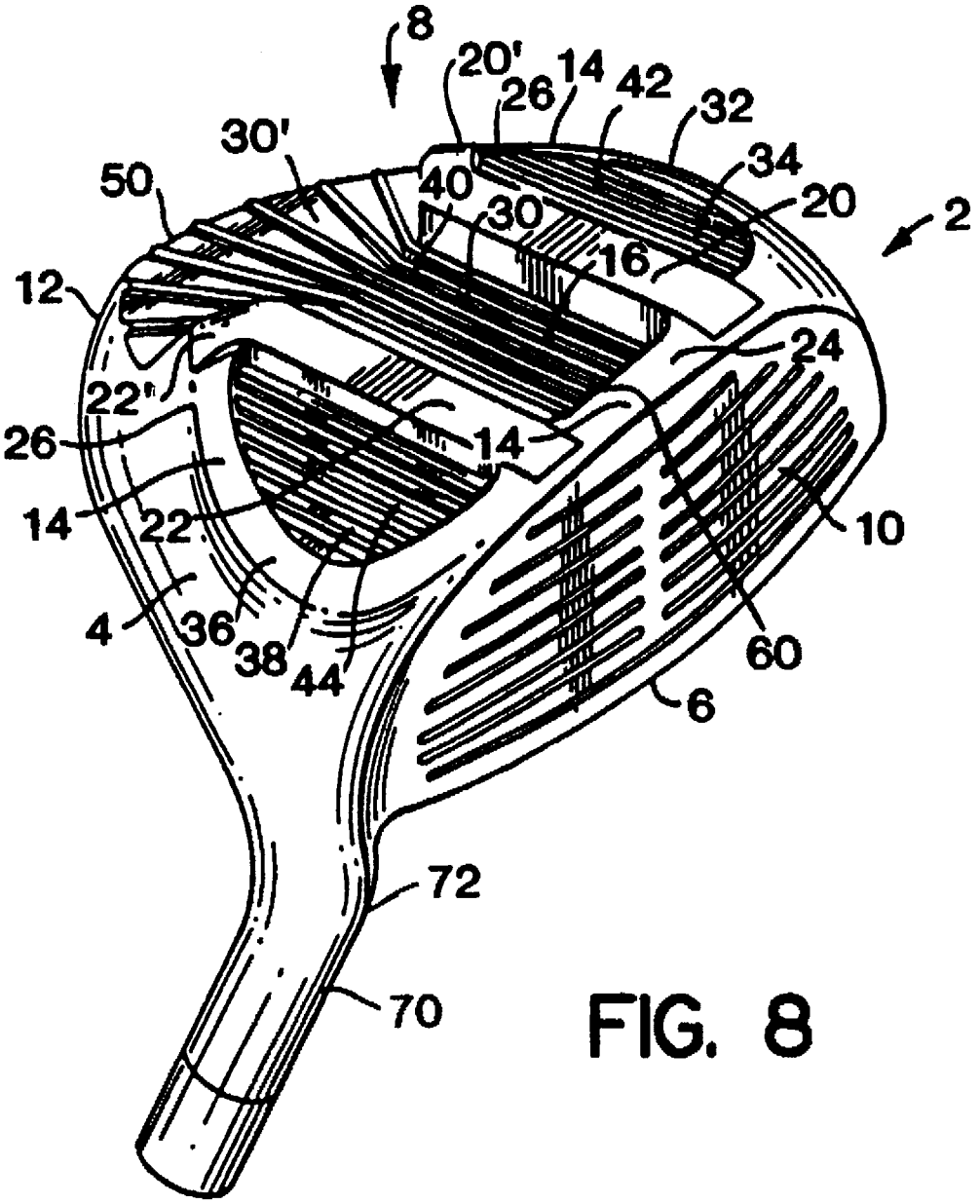
FIG. 8 is a perspective view of another form of golf club head illustrative of an alternative embodiment of the invention.

A bottom surface 40 of the central portion 30 of the sole cavity 16 may be disposed more deeply in the club head than bottom surfaces 42, 44 of the toe and heel portions 34, 38 of the sole cavity 16, as is shown in FIGS. 1 and 8 and more distinctly in the embodiment shown in FIG. 8. The sole cavity portion 30' between the diverging portions 20', 22' of the struts 20, 22 inclines upwardly toward the rear wall 12 and top portion 6. The presence of the sole cavity 16 facilitates disposition of the center of gravity of the club nearer the top portion 6. The presence of the sole cavity portion 30' aids in disposition of the center of gravity of the club nearer the top portion 6, and, in addition, facilitates location of the center of gravity nearer the face 10 of the club head.

Referring again to FIGS. 1, 6, 8 and 13, it will be seen that the toe portion 34 of the sole cavity 16 is entirely bounded by the first strut 20, 20' and the peripheral wall portion 32 adjacent the toe portion 2, and the heel portion 38 of the sole cavity 16 is entirely bounded by the second strut 22, 22' and the peripheral wall portion 36 adjacent the heel portion 4.

In both embodiments, but more pronouncedly in the embodiment shown in FIGS. 8–14, the struts 20, 22 extend outwardly from the club sole portion 8 further than the peripheral wall 14, that is, the struts are "taller" than the peripheral wall.

In both embodiments, the bottom surface 40 of the central portion 30 of the sole cavity 16 intersects the rear wall 12 of the club, to define an opening 50 in the rear wall 12.

Figure 6:
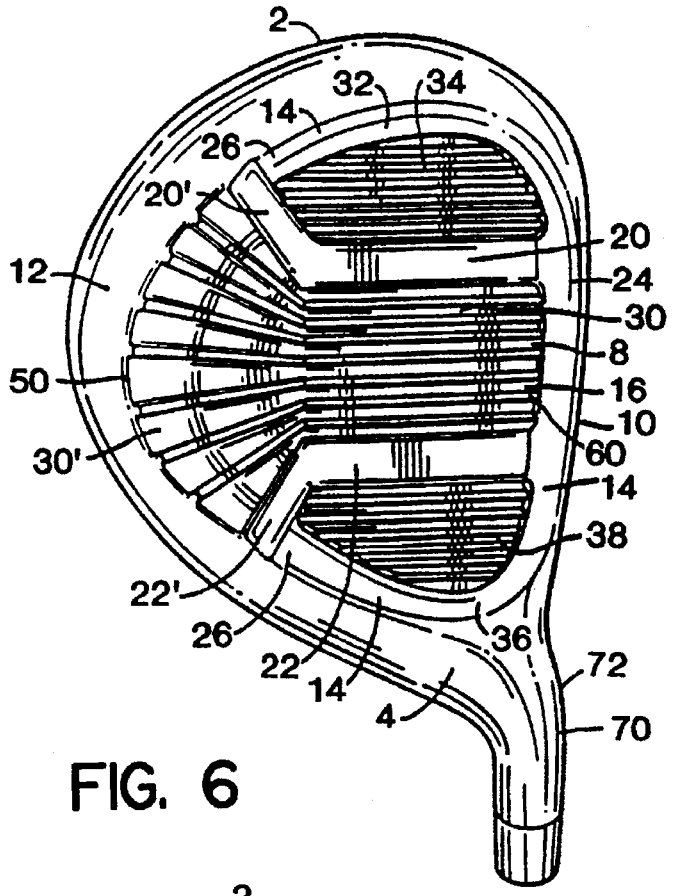
FIG. 6 is a bottom plan view thereof.
Figure 7:
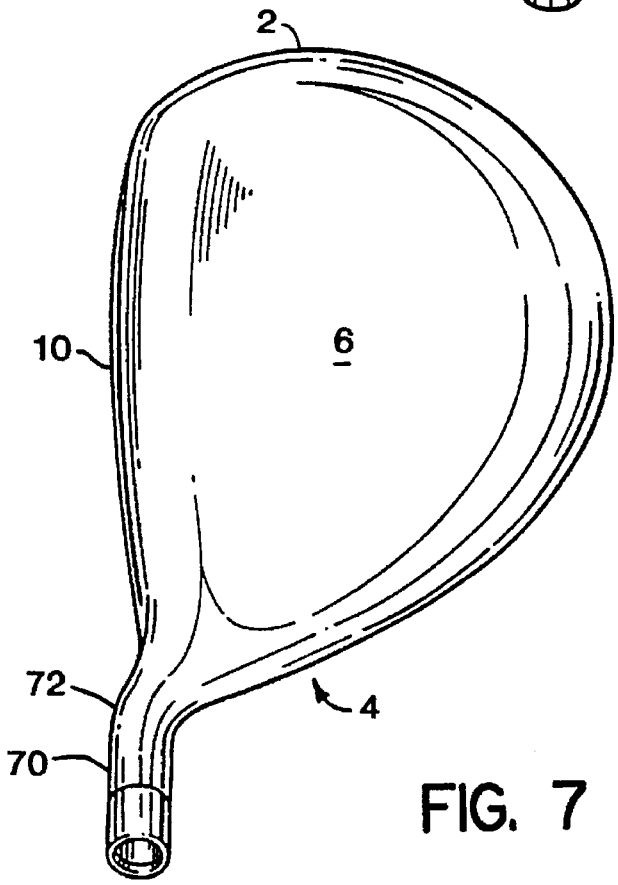
FIG. 7 is a top plan view thereof.
Figure 13:
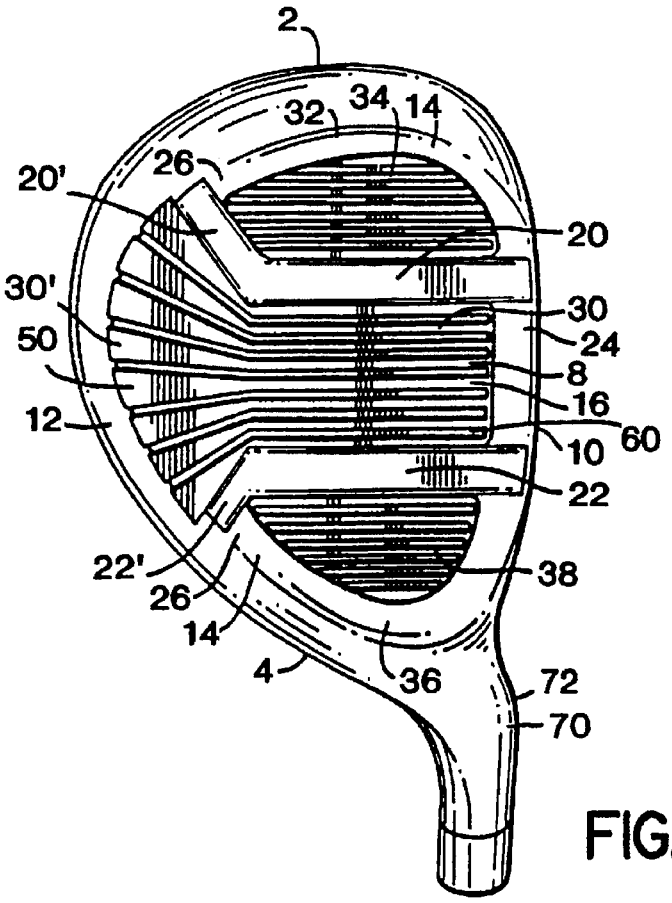
FIG. 13 is a bottom plan view thereof.
Figure 14:
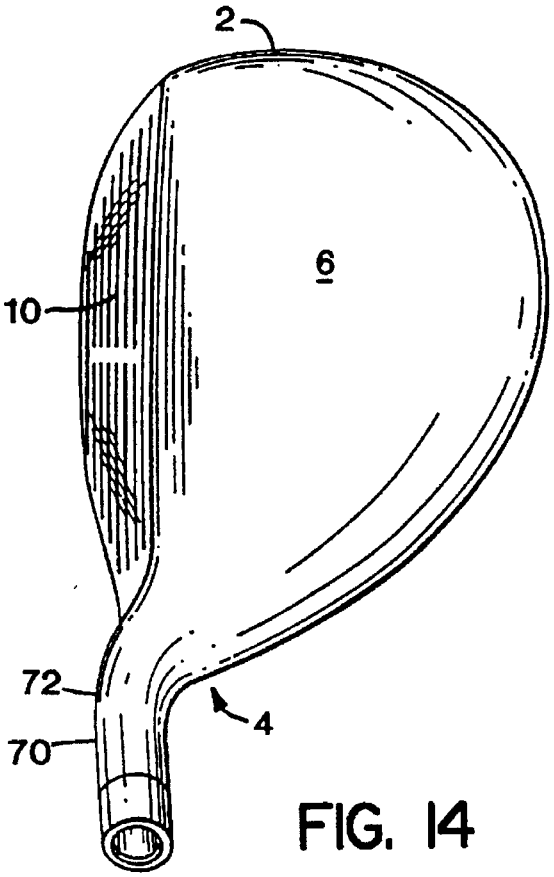
FIG. 14 is a top plan view thereof.
Figure 15:
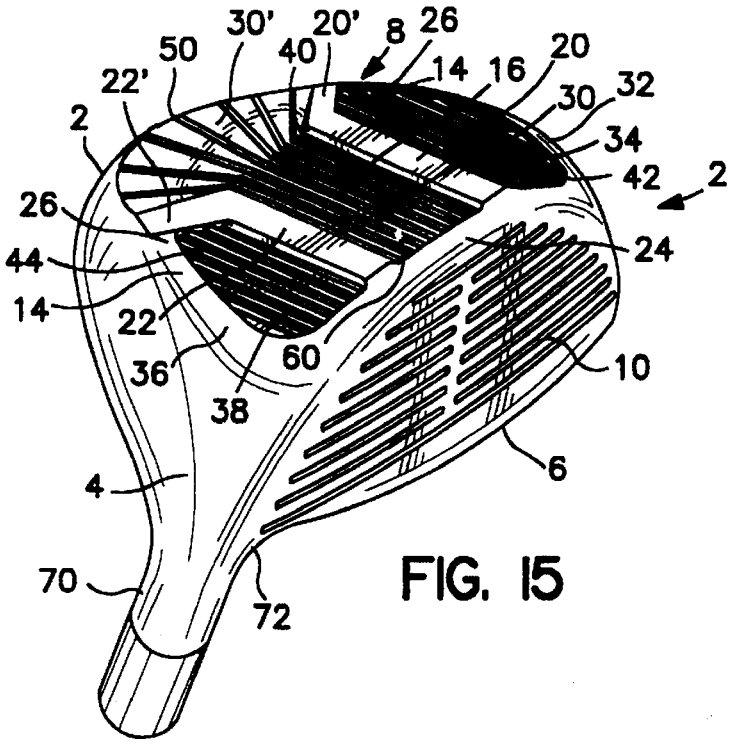
FIG. 15 is a perspective view of another form of golf club head illustrative of an alternative embodiment of the invention.
Figure 16:
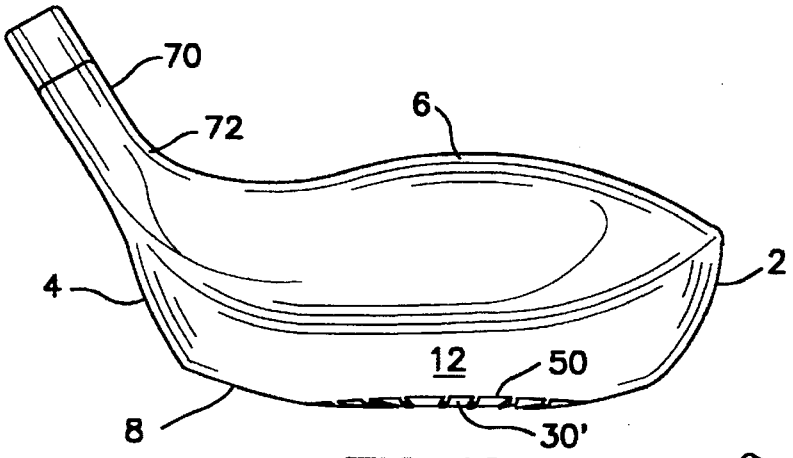
FIG. 16 is a rear elevational view thereof.
Figure 17:
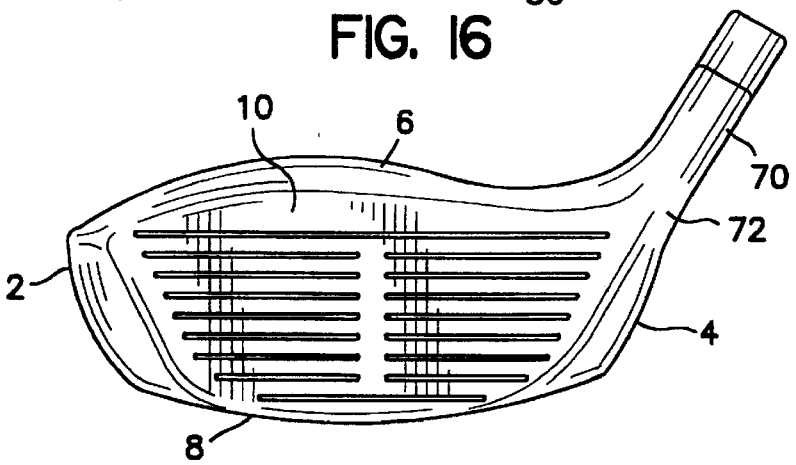
FIG. 17 is a front elevational view thereof.
Figure 18:
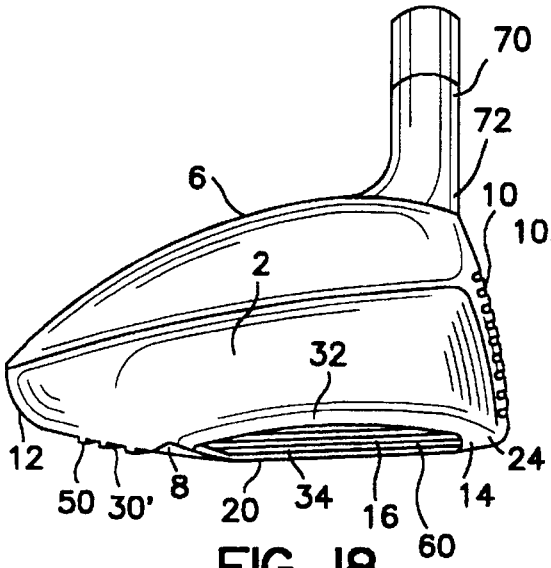
FIG. 18 is a toe end elevational view thereof.
Figure 19:
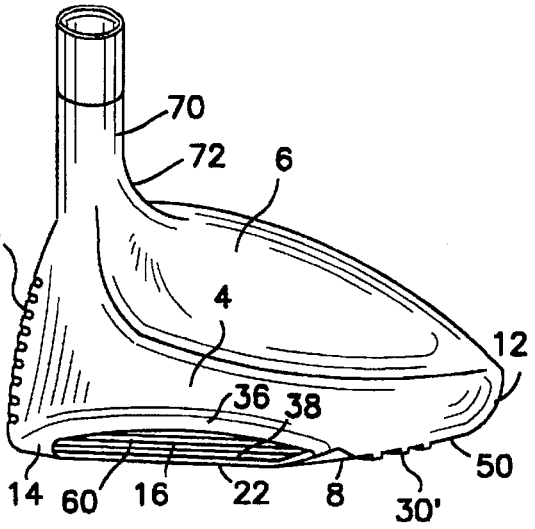
FIG. 19 is a heel end elevational view thereof.
Figure 21:
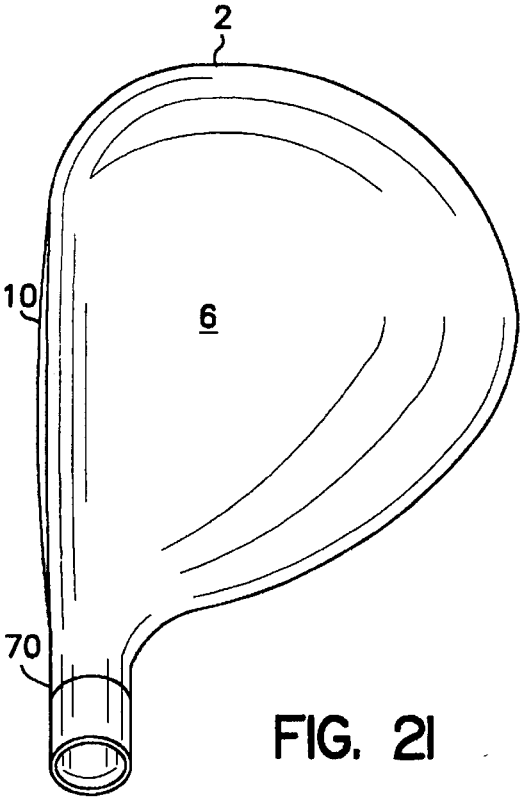
FIG. 21 is a top plan view thereof.

A series of rails 60 extend across the central portion 30 of the sole cavity 16 in a substantially parallel manner, and then diverge in the sole cavity portion 30' as shown in FIGS. 6 and 13. Rails 60 also extend across the toe and heel portions 34, 38 of the sole cavity in a substantially parallel manner. (FIGS. 6 and 13.) The rails help to improve the aerodynamic performance of the clubs, particularly when used on imperfect lies.

There is thereby provided a wood-type club head having protective struts formed on the sole portion thereof as an integral part of the club and formed so as to permit a higher and more forward location of a center of gravity, rather than further lowering the center of gravity.

Reference is now drawn to the clubs shown in FIGS. 15–29. As noted above, it is desirable to provide a set of golf club heads in which the center of gravity is placed at an optimum location for each club in the set. In the lower lofted clubs, the center of gravity is positioned lower in the club, toward the sole, as compared to the higher lofted clubs. However, as the loft of the club increases, the center of gravity is raised, so that in the higher lofted clubs, the location of the center of gravity will be higher than the location of the center of gravity for a conventional golf club having the same loft. In the preferred embodiment, the higher lofted clubs are clubs having a loft of greater than approximately 14 to 16 degrees.

The lower placement of the center of gravity in the lower lofted club helps lift the ball. The high placement of the center of gravity on the higher lofted club helps to reduce offshoot, and keep the ball in the desired trajectory.

Although the center of gravity rises toward the top of the club as the loft increases, the center of gravity remains at the approximate center of the club head relative to the face and rear of the club.

In the golf club set of the preferred embodiment, the clubs range in loft from 8.5 degrees for the least lofted number 1 wood, to 27 degrees for the highest lofted club, i.e. the number 9 wood. The least lofted club in the set is shown in detail in FIGS. 15–21. The highest lofted club in the set, the number 9 wood, is shown in FIGS. 22–28 FIG. 29 shows a perspective view of the set of club heads according to the preferred embodiment. The loft and corresponding figure numbers are set forth below:

| Figure | Wood Number | Loft (degrees) |
|---|---|---|
| 29(a) | 1 | 8.5 |
| 29(b) | 1 | 10.5 |
| 29(c) | 1 | 12.5 |
| 29(d) | 1 | 14 |
| 29(e) | 3 | 15.5 |
| 29(f) | 4 | 18 |
| 29(g) | 5 | 21 |
| 29(h) | 7 | 24 |
| 29(i) | 9 | 27 |

The specifications of the set of golf club heads of the preferred embodiment are set forth below:

| Loft (deg.) | Head Vol. (c.c.) | Weight (top shell) | Weight (sole plate) | Strut Height (measured from the bottom portion of the central cavity) |
|---|---|---|---|---|
| 8.5 | 185 | 152–158 g | 53–58 g | 2 mm |
| 10.5 | 185 | 153–162 g | 52–56 g | 2 mm |
| 12.5 | 178 | 155–164 g | 53–57 g | 2 mm |
| 14.0 | 170 | 149–159 g | 57–60 g | 2 mm |
| 15.5 | 162 | 155–163 g | 62–70 g | 5.5 mm |
| 18 | 152 | 155–163 g | 67–73 g | 6.5 mm |
| 21 | 140 | 159–164 g | 64–70 g | 6.5 mm |
| 24 | 120 | 156–168 g | 69–75 g | 7.0 mm |
| 27 | 110 | 156–168 g | 69–75 g | 7.0 mm |

The clubs shown in FIGS. 15–29 are similar to the clubs shown in FIGS. 1–14 in that each club has a peripheral wall 14 depending from the periphery of the sole portion 8 to define a sole cavity 16 in the sole portion, and two struts 20, 22 extend from a portion 24 of the peripheral wall 14 adjacent the front face 10 to a portion 26 of the peripheral wall 14 adjacent the rear wall 12. The struts 20, 22, are, in part, substantially parallel to each other and define therebetween, in cooperation with the portion 24 of the peripheral wall 14 adjacent the front face 10, a central portion 30 of the sole cavity 16. The struts, 20, 22 diverge from each other near the rear wall 12, such that the central portion 30 of the sole cavity is open to the rear of the club head. A first 20 of the two struts and a portion 32 of the peripheral wall 14 adjacent the toe portion 2 define a toe portion 34 of the sole cavity 16. A second 22 of the two struts and a portion 36 of the peripheral wall 14 adjacent the heel portion 4 define a heel portion 38 of the sole cavity 16. The toe portion 34 of the sole cavity 16 is entirely bounded by the first strut 20, 20' and the peripheral wall portion 32 adjacent the toe portion 2, and the heel portion 38 of the sole cavity 16 is entirely bounded by the second strut 22, 22' and the peripheral wall portion 36 adjacent the heel portion 4. The bottom surface 40 of the central portion 30 of the sole cavity 16 intersects the rear wall 12 of the club, to define an opening 50 in the rear wall 12.

In all of the clubs, but more pronouncedly in the higher lofted clubs (i.e. the club shown in FIGS. 22–28) the struts 20, 22 extend outwardly from the club sole portion 8 further than the peripheral wall 14. That is, the struts are "taller" than the peripheral wall. In all of the clubs in the set, the struts 20, 22 are approximately 8 to 8.5 mm wide in the central portion of the sole (where they are parallel to each other). At the diverging portion, the struts 20', 22' are approximately 5.5 to 6.0 mm wide.

Figure 20:
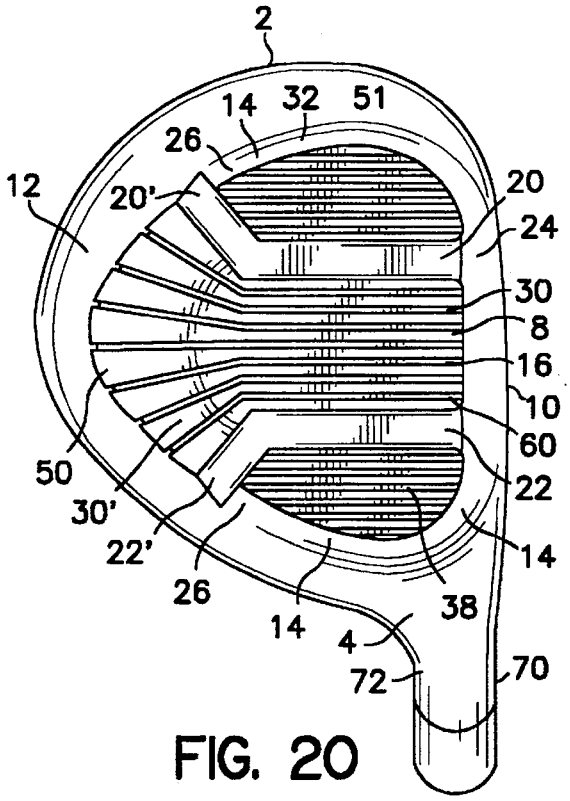
FIG. 20 is a bottom plan view thereof.
Figure 22:
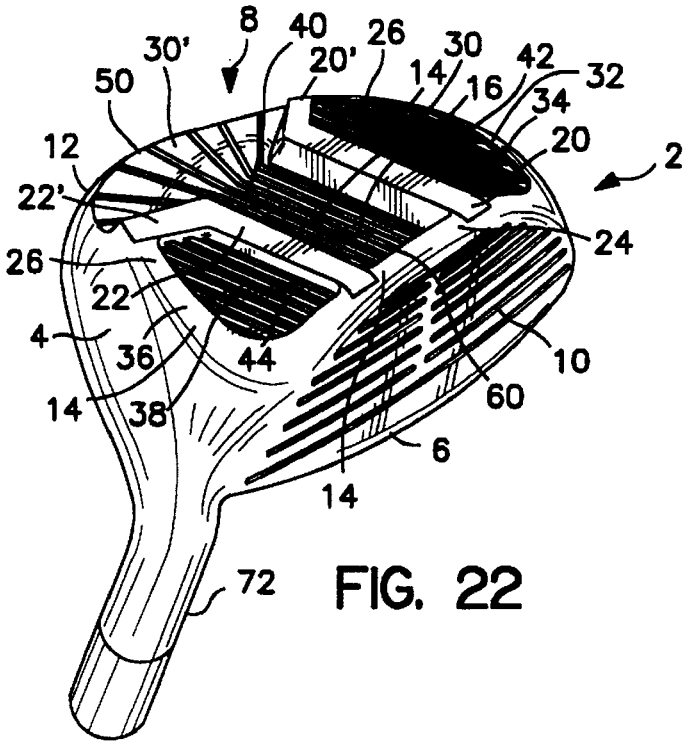
FIG. 22 is a perspective view of another form of golf club head illustrative of an alternative embodiment of the invention.
Figure 23:
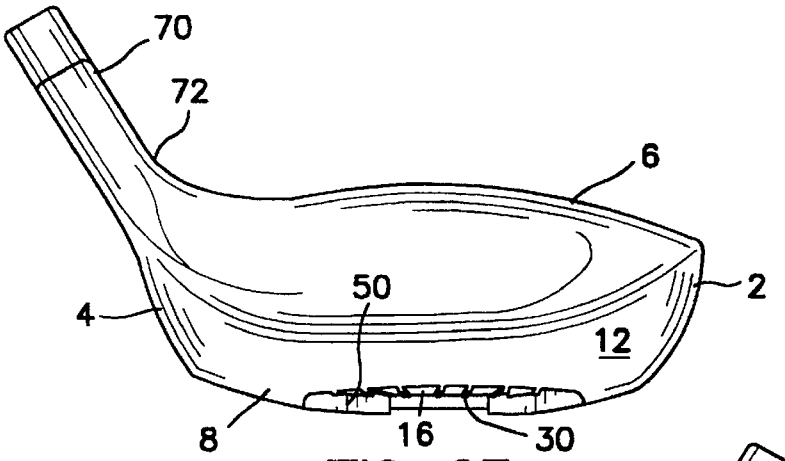
FIG. 23 is a rear elevational view thereof.
Figure 24:
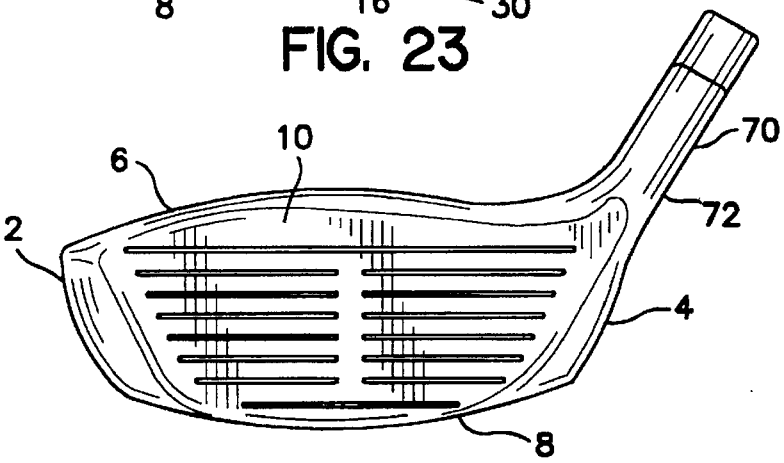
FIG. 24 is a front elevational view thereof.
Figure 25:
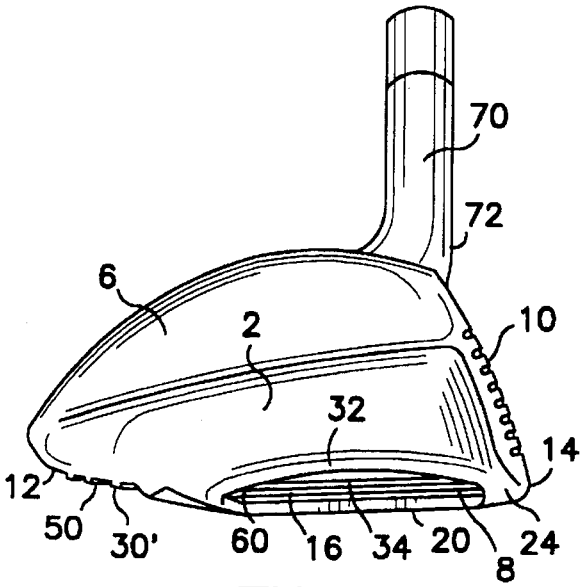
FIG. 25 is a toe end elevational view thereof.
Figure 26:
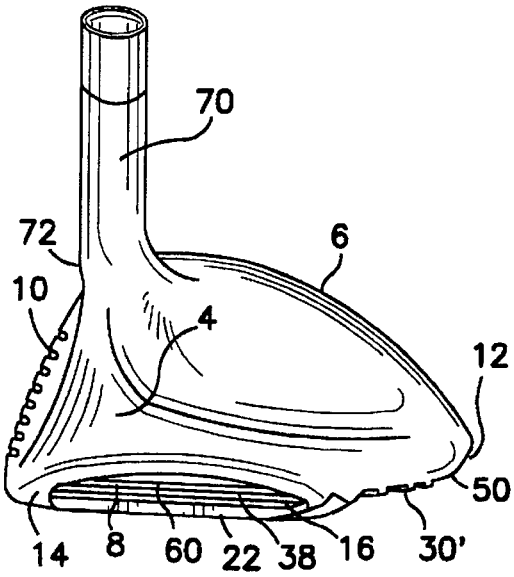
FIG. 26 is a heel end elevational view thereof.
Figure 28:
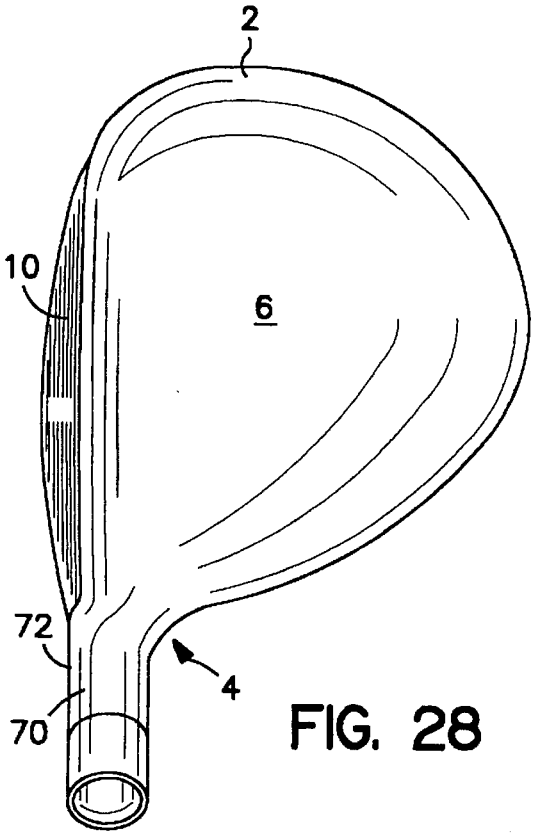
FIG. 28 is a top plan view thereof.
Figure 27:
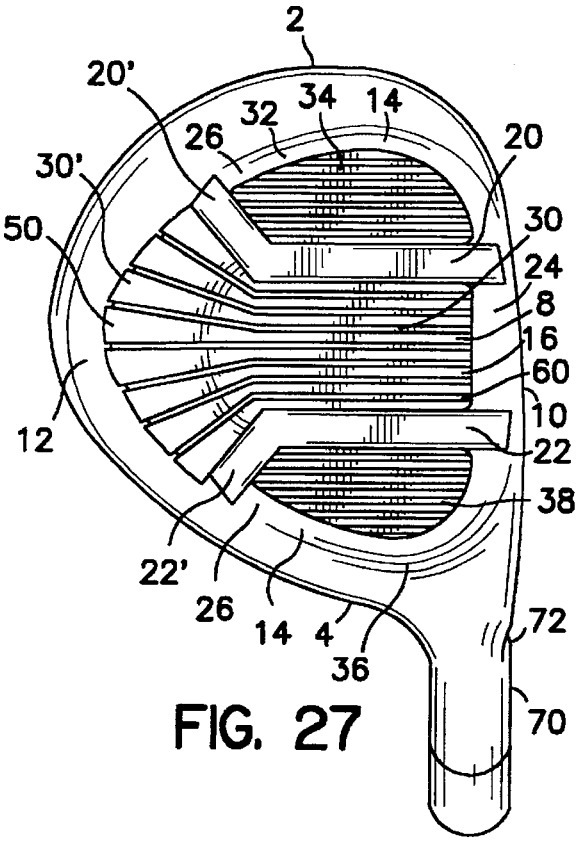
FIG. 27 is a bottom plan view thereof.
Figure 29A:
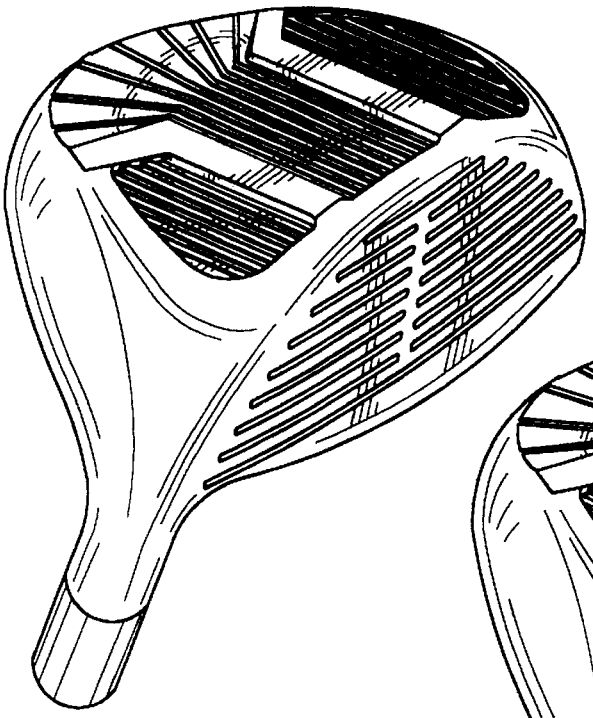
FIGS. 29(*a*)–FIG. 29 (*i*) show a perspective view of a set of golf club heads which includes the clubs shown in FIGS. 15 and 22.
Figure 29B:
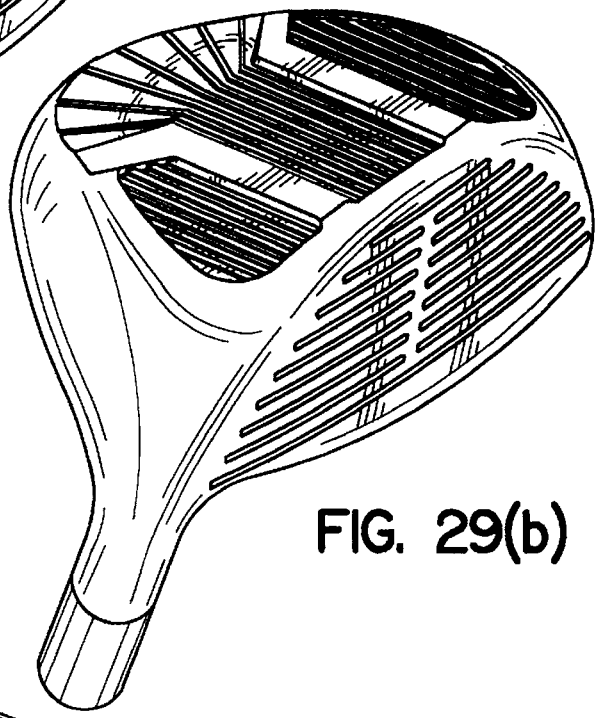
Figure 29C:
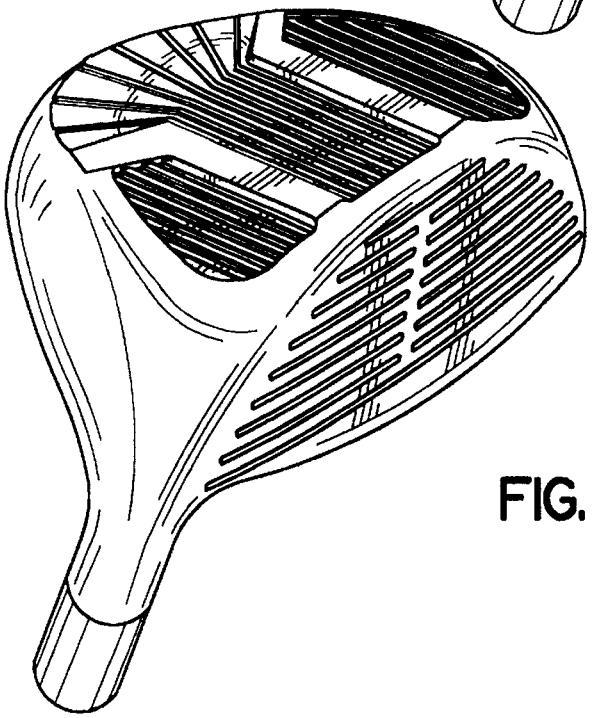
Figure 29D:
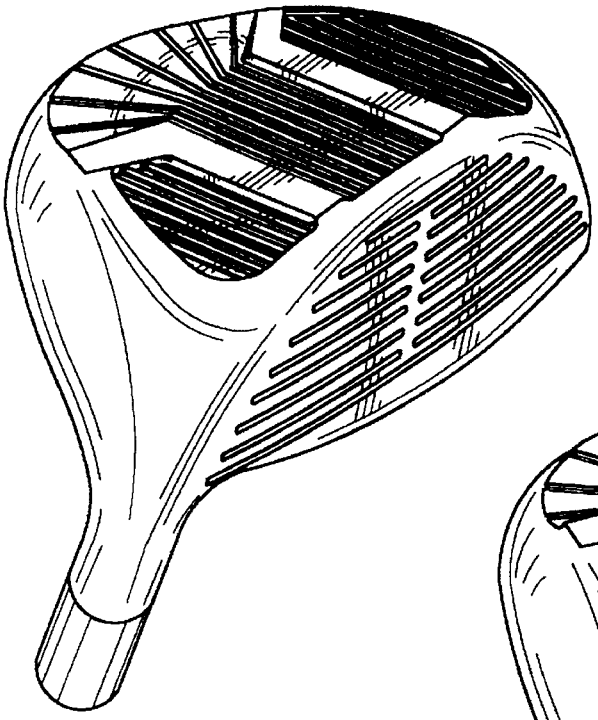
Figure 29E:
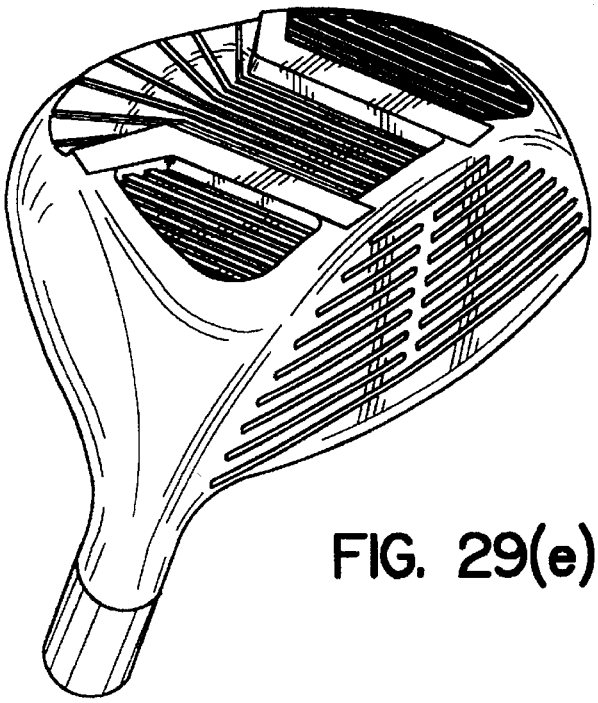
Figure 29F:
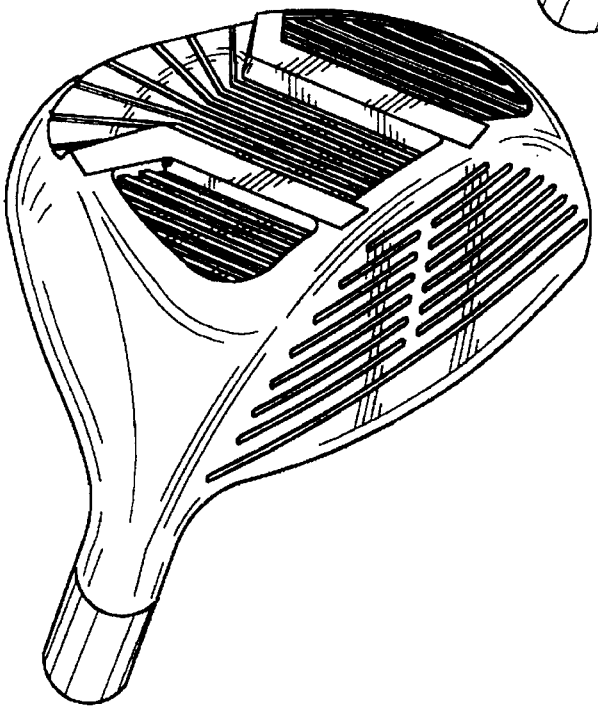
Figure 29G:
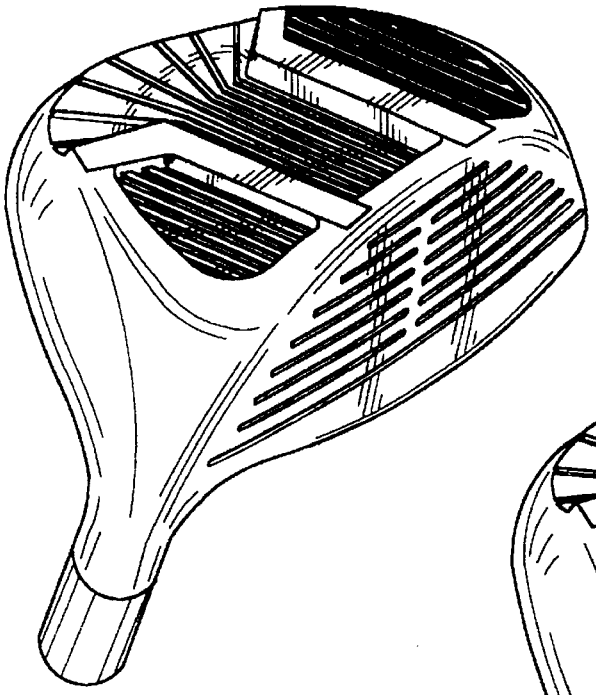
Figure 29H:
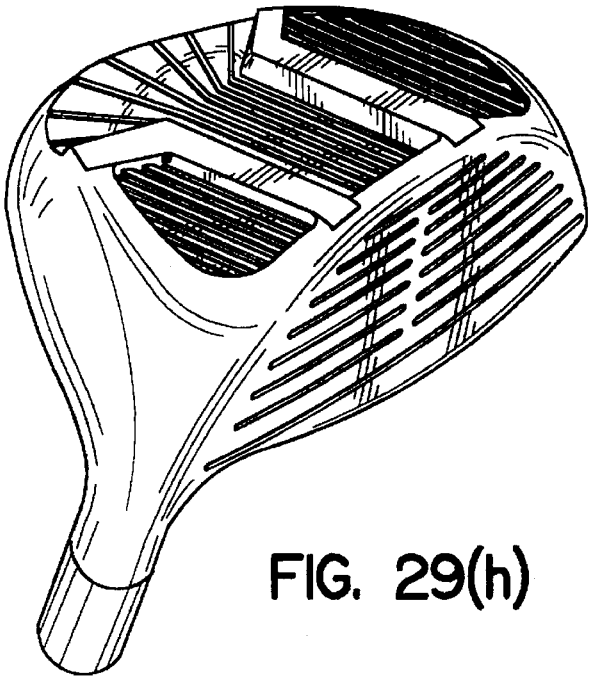
Figure 29I:
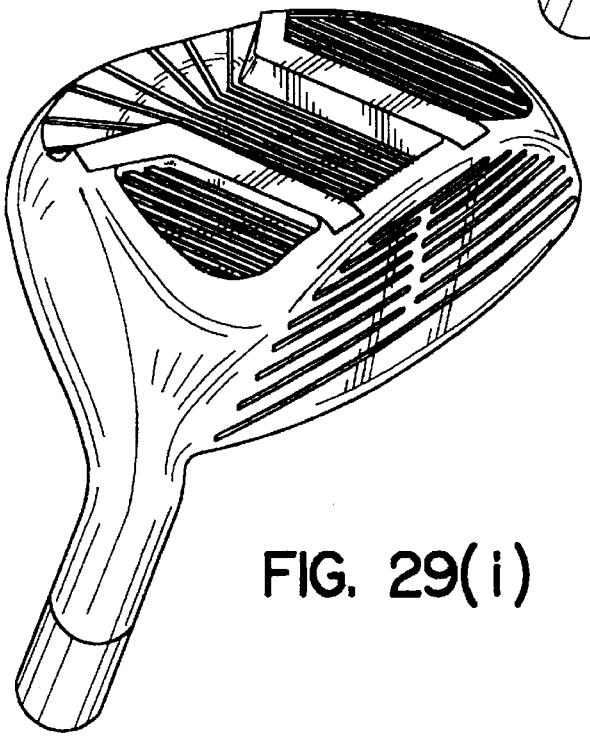

A series of rails 60 extend across the central portion 30 of the sole cavity 16 in a substantially parallel manner, and then diverge in the sole cavity portion 30' as shown in FIGS. 20 and 27. Rails 60 also extend across the toe and heel portions 34, 38 of the sole cavity in a substantially parallel manner. (FIGS. 20 and 27)

As noted above, in the clubs shown in FIGS. 15–29 the center of gravity is placed toward the sole portion 8 in the lower lofted clubs, and toward the top portion 6 of the club on the higher lofted clubs. As shown in FIG. 29, as the loft of the clubs in the set increase, the depth of the central portion 30 of the sole cavity 16 also increases. By increasing the depth of the central portion 30 of the sole cavity 16, weight is made available to raise the center of gravity.

Furthermore, in the clubs shown in FIGS. 15–29 additional weight is placed on the top portion 6 of the club toward the toe portion 2, resulting in somewhat of a teardrop shaped appearance. That is, the top portion 6 of the club head near the toe portion 2 extends slightly higher in the clubs shown in FIGS. 15–29, than in the clubs shown in FIGS. 1–14. The additional weight on the top portion 6 helps to raise the center of gravity.

The length of the hosel portion 7 of the club may be adjusted to optimize location of the center of gravity. A shorter hosel will lower the center of gravity, whereas a longer hosel will raise the center of gravity. For example, in the set according to the preferred embodiment, the length of the hosel 7 on the highest lofted club, the number 9 wood, (FIGS. 22–28) is longer than the length of the hosel 7 for the other clubs in the set.

There is thereby provided a set of wood-type club heads having protective struts formed on the sole portion thereof as an integral part of the club in which the center of gravity can be placed in the optimum location for each club in the set.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and there is no intention to exclude any equivalents thereof. Hence, it is recognized that various modifications are possible within the scope of the present invention as claimed.

Having thus described my invention, what I claim as new and desire to secure by Letters Patent of the United States is:

1. A set of golf club heads, comprising at least a first and second golf club head, each having a toe portion, a heel portion, a top portion, a sole portion, a front face bounded by said toe, heel, top and sole portions, and a rear wall bounded by said toe, heel, top and sole portions, a peripheral wall depending from the periphery of said sole portion to define a sole cavity in the sole portion, and two struts extending from a portion of said peripheral wall adjacent said front face to a portion of said peripheral wall adjacent said rear wall, said struts being substantially parallel to each other adjacent said portion of said peripheral wall adjacent said front face and diverging from each other toward said portion of said peripheral wall adjacent said rear wall, said struts defining therebetween and in cooperation with said portion of said peripheral wall adjacent said front face a central portion of said sole cavity, said first golf club head having a loft of less than a loft of the second golf club head, and said central portion of said sole cavity of said first golf club head having a depth of less than a depth of said sole cavity of said second golf club head, wherein a location of a center of gravity in said first golf club head is lower in said first golf club head than a location of the center of gravity in said second club head.

2. The set of golf club heads of claim 1, wherein said peripheral wall is interrupted adjacent said rear wall, and a bottom surface of said central portion of said sole cavity intersects said rear wall and in cooperation with said two struts defining said interruption in said peripheral wall, defines an opening rearwardly of said club head.

3. The set of golf club heads of claim 1 wherein the location of the center of gravity in each golf club head in the set is raised as the loft of the golf club head increases.

4. The set of golf club heads of claim 1 wherein said first and second golf club head each have struts extending outwardly from the club sole portion further than said peripheral wall.

5. The set of golf club heads of claim 4 wherein said struts of said second golf club head extend further from said sole portion than said struts of said first golf club head.

6. The set of golf club heads of claim 1 wherein a depth of said central cavity of each golf club head in said set increases as the loft of said golf club head increases.

7. The set of golf club heads of claim 1 wherein the golf club heads range in loft from approximately 8.5 degrees for a least lofted club to a maximum of 27 degrees for a highest lofted club.

8. The set of golf club heads of claim 7 wherein the center of gravity is placed toward the sole of the club on the least lofted club and toward the top of the club on the highest lofted club.

9. The set of golf clubs of claim 1 wherein the location of the center of gravity is not uniform for all of the clubs in the set.

10. The set of golf club heads of claim 1 wherein the location of the center of gravity for the first and second golf club heads is at the approximate center of the golf club head relative to the face and rear of the golf club head.

11. The set of golf clubs of claim 1 wherein the struts are approximately 8 to 8.5 mm wide where they are substantially parallel to each other.

12. The set of golf clubs of claim 1 wherein the struts are approximately 5.5 to 6.0 mm wide where they are diverging from each other.

13. A set of golf clubs, comprising at least a first and second golf club, each having a hosel, and a head attached to said hosel, each head having a toe portion, a heel portion, a top portion, a sole portion, a front face bounded by said toe, heel, top and sole portions, and a rear wall bounded by said toe, heel, top and sole portions, a peripheral wall depending from the periphery of said sole portion to define a sole cavity in the sole portion, and two struts extending from a portion of said peripheral wall adjacent said front face to a portion of said peripheral wall adjacent said rear wall, said struts being substantially parallel to each other adjacent said portion of said peripheral wall adjacent said front face and diverging from each other toward said portion of said peripheral wall adjacent said rear wall, said struts defining therebetween and in cooperation with said portion of said peripheral wall adjacent said front face a central portion of said sole cavity, said head of said first golf club having a loft of less than a loft of said head of said second golf club, and said central portion of said sole cavity of said first golf club having a depth of less than a depth of said sole cavity of said second golf club, wherein a location of a center of gravity in said head of said first golf club is lower in said head than a location of the center of gravity in said head of said second golf club head, and said hosel of said second golf club is longer than said hosel of said first golf club.

* * * * *